United States Patent [19]

Campbell

[11] 4,119,271

[45] Oct. 10, 1978

[54] RAIL BRACING SYSTEM

[76] Inventor: Frank A. Campbell, 111 Catalpa Ave., Hackensack, N.J. 07601

[21] Appl. No.: 786,055

[22] Filed: Apr. 8, 1977

[51] Int. Cl.[2] ..... E01B 9/60; E01B 9/48

[52] U.S. Cl. ..... 238/336; 238/292; 238/310; 238/349

[58] Field of Search ..... 238/172, 281, 292, 293, 238/310, 315, 336, 337, 338, 343, 349

[56] References Cited

U.S. PATENT DOCUMENTS

| | | | |
|---|---|---|---|
| 1,695,993 | 12/1928 | Brownridge | 238/315 |
| 2,450,559 | 10/1948 | Parsons | 238/349 |
| 3,004,716 | 10/1961 | Pande-Rolfsen | 238/349 |

FOREIGN PATENT DOCUMENTS

| | | | |
|---|---|---|---|
| 1,139,863 | 11/1962 | Fed. Rep. of Germany | 238/336 |

*Primary Examiner*—Randolph A. Reese

*Attorney, Agent, or Firm*—Lee C. Robinson, Jr.

[57] ABSTRACT

A combined rail fastener and brace for fastening rails to a railroad tie and to provide lateral bracing for the rail. The rail fastener and brace cooperates with a base plate secured to the railroad tie and includes a torsion spring member having one segment adapted to engage the extending flange of a rail and another segment of the torsion spring member positioned to abut the upper portion of the rail to provide lateral bracing against horizontal forces imparted to the rails during movement of trains thereon.

14 Claims, 10 Drawing Figures

RAIL BRACING SYSTEM

BACKGROUND OF THE INVENTION

The present invention relates generally to a railway rail fastener and more particularly to a railway rail fastener which secures a rail to a railroad tie or a slab while simultaneously providing support to the rail against horizontal forces.

In rail systems there are many instances where unusual horizontal forces are placed on the rails which tend to cause misalignment and changes in the gauge of the track as well as overturning of rails. Such lateral forces occur where the tracks are curved and where braking forces on a train's wheels are uneven causing erratic wheel behavior, for instance when only one wheel will grab which causes a pivoting moment to be imparted to the wheels' axle and/or its truck assembly tending to greatly increase transverse forces on the rail. In addition, out of round wheels or uneven wheel surfaces or undulations in the track bed cause vibration as the train wheels pass over the track which also puts uneven and erratic transverse forces onto the rails. Thus for optimum track installation and to minimize track maintenance necessary to reset rails to the correct gauge it is desirable to provide lateral bracing to the rails. Since the rails must also be secured to the respective ties, or a base slab where ties are not used, the solution offered by the present invention, that is a combined rail fastener and brace which is easily installed and removed affords a unique solution to the problem of securing and bracing rails.

Heretofore, rail fastening systems have been proposed for securing railroad rails to railway ties or other base members but typically such fastening means have made no provision to support the rail and brace it against lateral or horizontal forces imparted to the rail due to the passage of trains thereon.

Some prior art rail fastening systems have suggested means to provide lateral bracing to the rail but these systems utilize auxiliary means as the lateral bracing member and most require special constructions for the railroad tie and are not universally adaptable to all types of railroad ties.

SUMMARY

Accordingly, it is an object of the present invention to provide a fastener for a rail which secures the rail to an underlying railroad base member, such as a tie, while also providing lateral support to the rail.

It is a further object of the present invention to provide a unitary rail fastener which simultaneously secures the rail to a railroad tie while also providing lateral support to the rail member.

It is a still further object of the present invention to provide a unitary rail fastener and lateral brace member which is relatively simple to construct and relatively easy to install.

A still further object of the present invention is to provide a combined rail fastener and rail brace which effectively secures rails to railway ties or other types of supporting members while also stabilizing the rail against transverse forces resulting from sudden transverse loading due to erratic train behavior and uneven application of braking forces on train wheels.

These and other objects and advantages of the present invention will become more readily apparent after consideration of the following specification and accompanying drawings in which:

DESCRIPTION OF CERTAIN PREFERRED EMBODIMENTS

Figure 1:
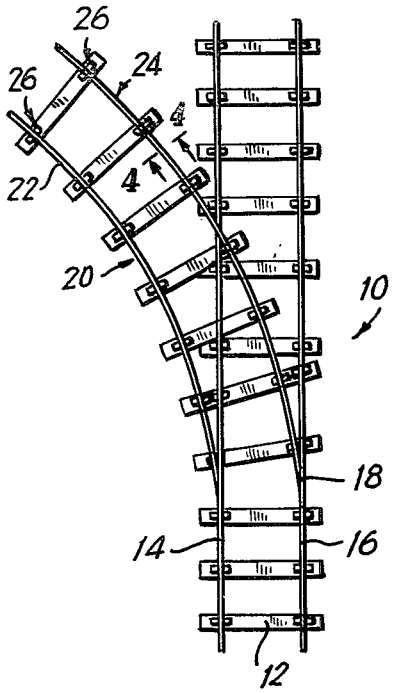
FIG. 1 is a plan view showing a section of track on which the rail fastener and brace of the present invention is installed.

Referring to FIG. 1, there is illustrated a railroad track system 10 which includes a plurality of spaced railroad ties 12 supporting parallel rails 14 and 16 meeting a "turnout" at 18 having a curved segment of track 20. The curved segment 20 includes spaced concentric rail segments 22 and 24 which are secured to the respective railroad tie 12, as are parallel rail sections 14 and 16, by the rail fastener and brace 26 of the present invention.

Figure 2:
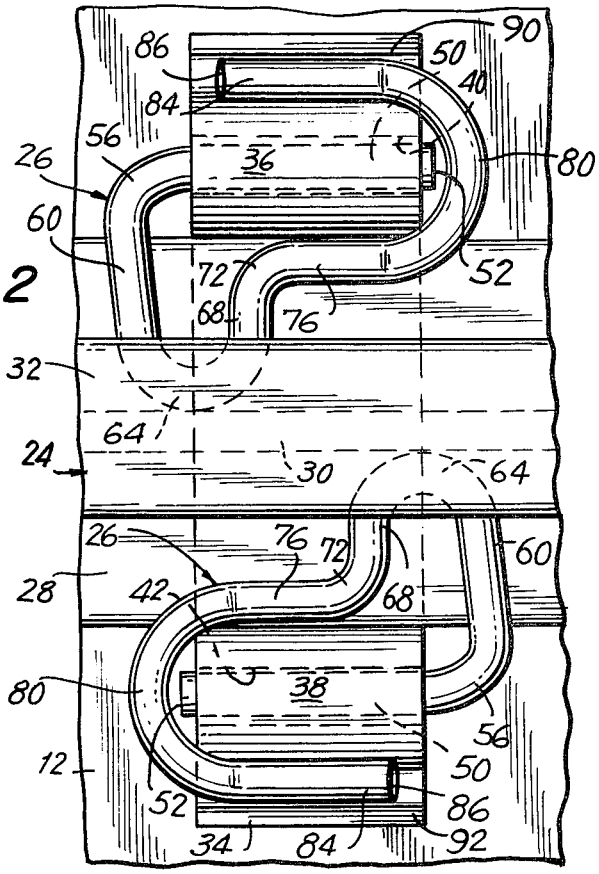
FIG. 2 is a top plan view of a segment of track showing one embodiment of the rail fastener and brace of the present invention.
Figure 3:
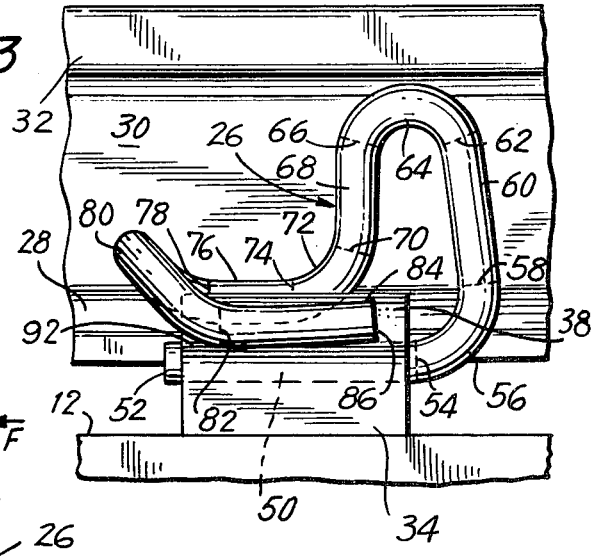
FIG. 3 is an elevational view of the embodiment of the rail fastener shown in FIG. 2.
Figure 4:
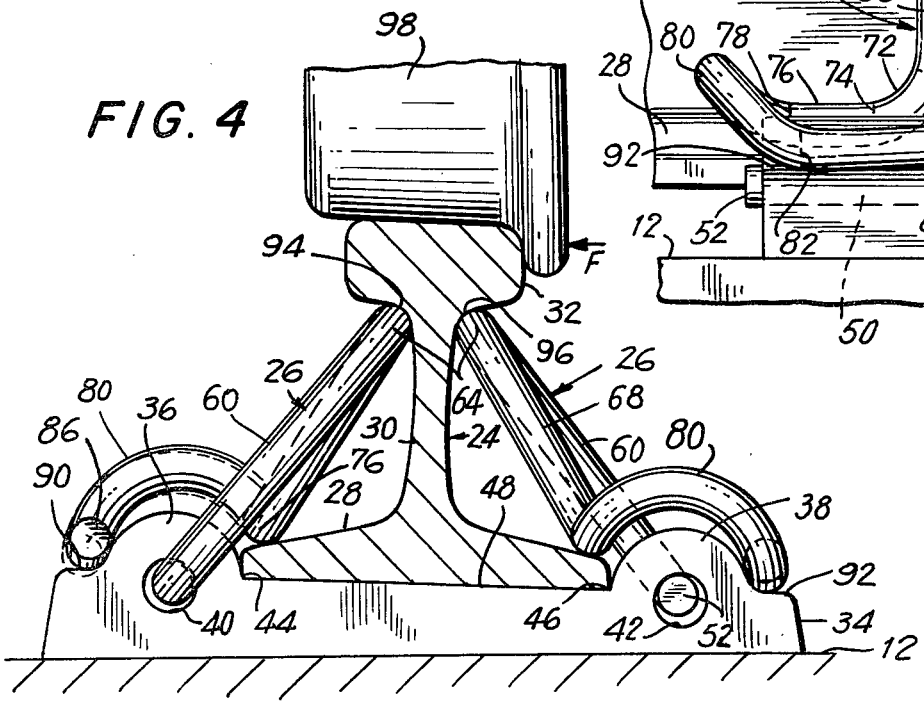
FIG. 4 is a vertical section through a rail showing the rail brace and fastener of the embodiment of FIG. 2 with a partial elevational view of a train wheel riding thereon.

As best seen in FIGS. 2 through 4, a typical rail section 24, which includes a flanged base segment 28, vertical section 30 and flanged wheel bearing surface 32 is supported by a base plate 34 secured to railway ties 12 in any conventional manner. Base plate 34 includes spaced protruding segments 36 and 38 having respective through bores 40 and 42 therethrough.

While the present invention will be described with reference to wooden ties having a base plate 34 thereon it is expressly understood that concrete ties, concrete slabs or other base designs may also be used in place of wooden ties. In many such cases, only the segments 36 and 38 need be present with each being anchored directly into the concrete or other material. The cant or slope of base plate 34, if required, would be formed in the base material.

The protruding segments 36 and 38 on each base plate 34 are spaced so that the junction of the respective protuberances, 44 and 46 respectively, with the upper surface 48 of base plate 34 are spaced from each other a sufficient distance to satisfactorily accommodate the flanged base segment 28 of a rail 24.

The rail fastener and brace 26 is formed of a unitary length of steel which is circular in cross section and which exhibits torsional resiliency so as to be deformable to permit installation and provide sufficient force to secure the rail to the base plate 34 and provide a brace against lateral forces on rail 24. In the embodiment shown in FIGS. 2 through 4, rail fastener and brace 26 includes a first straight leg portion 50 which extends from a first end 52 to the approximate position indicated by the dotted line 54. Adjacent the straight leg portion 50 is a reverse bend portion 56 which extends approximately from the position indicated by dotted line 54 to the position indicated by dotted line 58 and continues in a second straight leg portion 60 from position 58 to the position indicated by dotted line 62. A second reverse bend 64 continues from the position 62 to the position indicated by dotted line 66 and provides approximately a 180° change in orientation. A third straight leg portion 68 extends from position 66 to the position indicated by dotted line 70. Yet another reverse bend 72 continues from position 70 to the position indicated by dotted line 74 culminating in a fourth straight leg portion 76 indicated by the dotted line portions 74 and 78 merging into a fourth reverse bend segment 80 from position 78 to the position indicated by the dotted line 82. Reverse bend segment 80 provides a 180° change in the orientation of the rodlike member. The rail fastener 26 terminates in a gradual bend portion 84 which extends from the position indicated by dotted line 82 to the end of the rod 86.

The rail fastener and brace 26 has four major bearing surfaces when it is assembled in conjunction with a rail 24 and base plate 34. The first straight leg 50 is inserted within one of the through bores 40 or 42 in base plate 34 with the gradual bend segment 84 positioned on shoulders 90 and 92, respectively, formed by the exterior juncture of the respective protuberances 36 and 38 with the upper surface of base plate 34.

Upper reverse bend segment 64 abuts against the juncture 94 and 96, respectively, of the under side of the rail bearing surface 32 and the vertical web portion 30 of rail 24. The lower surface of straight leg segment 76 rests on the upper surface of flanged segment 28 to firmly secure the rail 24 to base plate 34.

On installing the rail fastener and brace 26, the straight leg segment 50 is inserted within the through bore 40 or 42 of base plate 34 and hammered into place. The configuration of the shoulder 92 and flange 28 of the rail serve as a camming surface which deforms reverse bend segment 80 slightly, as indicated in dotted line in FIG. 4. This deformation imparts a spring force to the fastener so that, in essence, the rail fastener and brace acts as a torsional spring holding down the rail and bracing it at the same time.

The straight leg segments 60 and 68 which extend from reverse bend segment 64 are not coplanar and, as seen in FIG. 4, for this reason present a supporting structure for the reverse bend segment 64 in abutting relationship against shoulder 94 which better resists the tendency of the brace to pivot away from abutting contact with the rail. This orientation of the straight leg segments 60 and 68 also greatly increases the resistance to any bending moment tending to move the reverse bend segment 64 away from contact with the rail.

As best seen in FIG. 4, a segment of a train wheel 98 is shown riding on the wheel bearing surface 32. FIG. 4 depicts the outside rail 24 of the curved segment 20, shown in FIG. 1, and as the train traverses the curved segment 20 of track it is subject to centrifugal forces tending to place an outward or horizontal force on the rail 24 as indicated by the arrow "F" in FIG. 4. The reaction to "F" is at 94 on the field side of the outside rail. In addition, the centrifugal force tends to cause a bending moment on the rail 24 which also has a lateral or horizontal force component. With the rail fastener and brace 26 in place, the abutting reverse bend segment 64 supported by the straight leg segments 60 and 68 resists the lateral force components placed on the rail and braces the rail against these force components to insure against displacement and misalignment of the rails.

Figure 5:
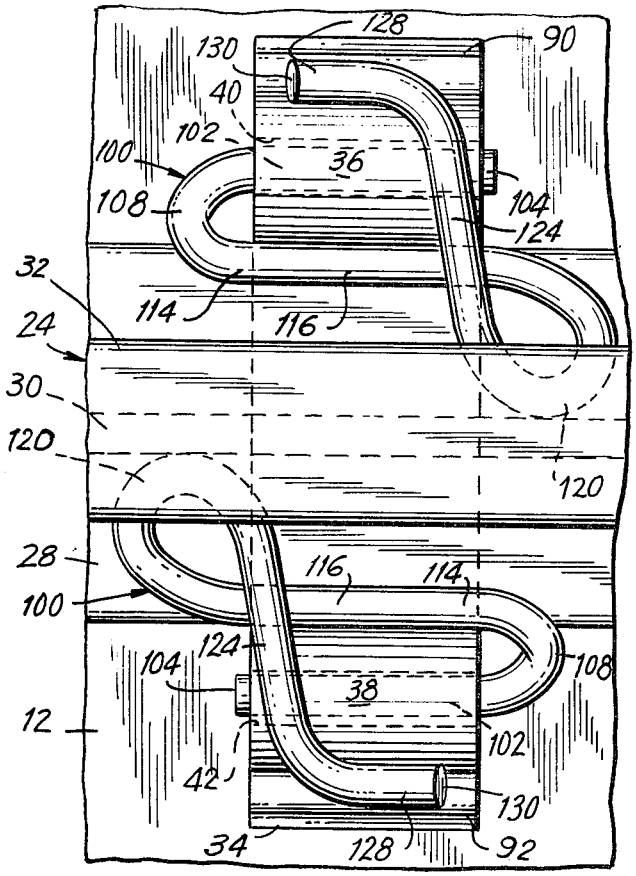
FIGS. 5, 6 and 7 are views similar to FIGS. 2, 3 and 4 showing an alternate embodiment of the rail fastener and brace of the present invention.
Figure 6:
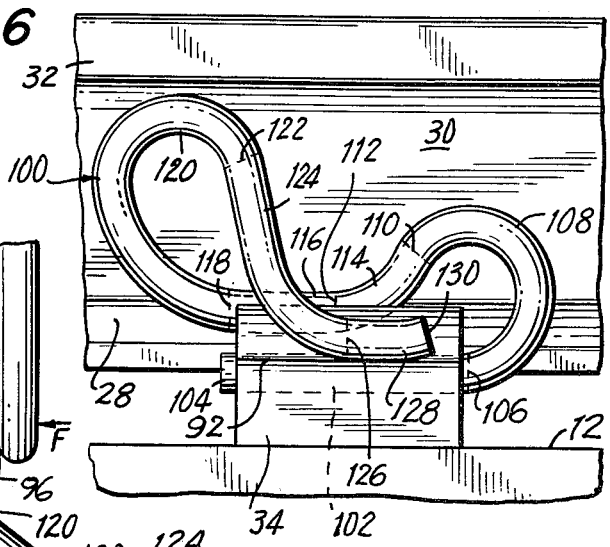
Figure 7:
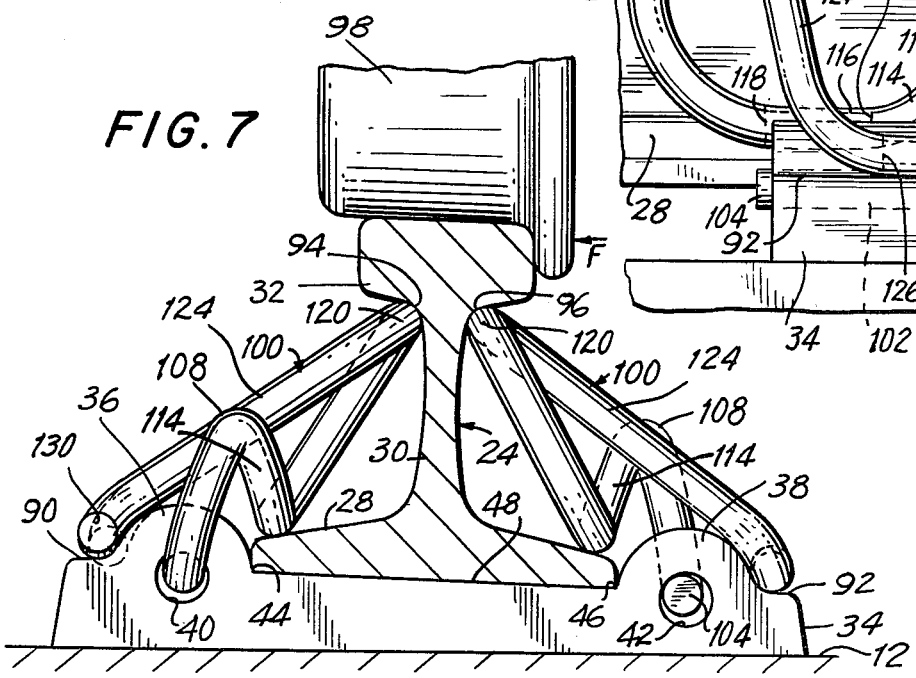

Reference is now made to FIGS. 5 through 7 for a description of an alternate embodiment of the fastener and brace of the present invention where like reference numerals refer to elements which are the same as elements in FIG. 2 through 4.

As in the embodiment of FIGS. 2 through 4, the rail fastener and brace 100 is formed of a unitary length of steel, circular in cross section and which exhibits torsional resiliency. This embodiment includes a first straight leg portion 102 which extends from a first end 104 to the position indicated by the dotted line 106 and extends into a reverse bend section 108 which changes the orientation of the fastener approximately 270° up to the approximate position marked by the dotted line 110. From the position marked by dotted line 110 to the position marked by dotted line 112 is a slight reverse bend segment 114 which continues into a short straight leg portion 116 extending from the position indicated by the dotted line 112 to the position indicated by dotted line 118. A third reverse bend section 120 extends from the position indicated by the dotted line 118 to the position indicated by the dotted line 122 and effects a change in orientation of approximately 270°. The fastener continues in a gradual bend segment 124 which extends from the position indicated by dotted line 122 to the position indicated by dotted line 126 and terminates in a short gradual bend segment 128 extending from the position indicated by dotted line 126 to the end of the fastener 130.

As in the embodiment of FIGS. 2 through 4, the first straight leg segment 102 is positioned within one of the through bores 40 or 42 in base plate 34 with the short gradual bend segment 128 seated on shoulders 90 or 92 and the reverse bend segment 120 against the shoulders 94 or 96 of the rail 24.

Fastener 100 is installed in the same manner as is fastener 26 and also provides a resilient torsion spring member to secure the rail to the base plate 34 while simultaneously providing a brace for horizontal forces imparted to the rail. Thus on installation as the fastener 100 is driven on, short gradual bend 128 rides up on shoulder 90 (as indicated in dotted line) to impart the spring force to the fastener. With this configuration the straight leg segment 116 rides on the surface of flange 28 of the rail and the reverse bend segment 120 is in abutting relationship with shoulders 94 or 96. As in the embodiment of FIGS. 2 through 4, the supporting leg segments to the reverse bend segment 120 in abutting relationship with the rail are not coplanar to provide greater rigidity and resistance to bending moment forces imparted to the rail.

Figure 8:
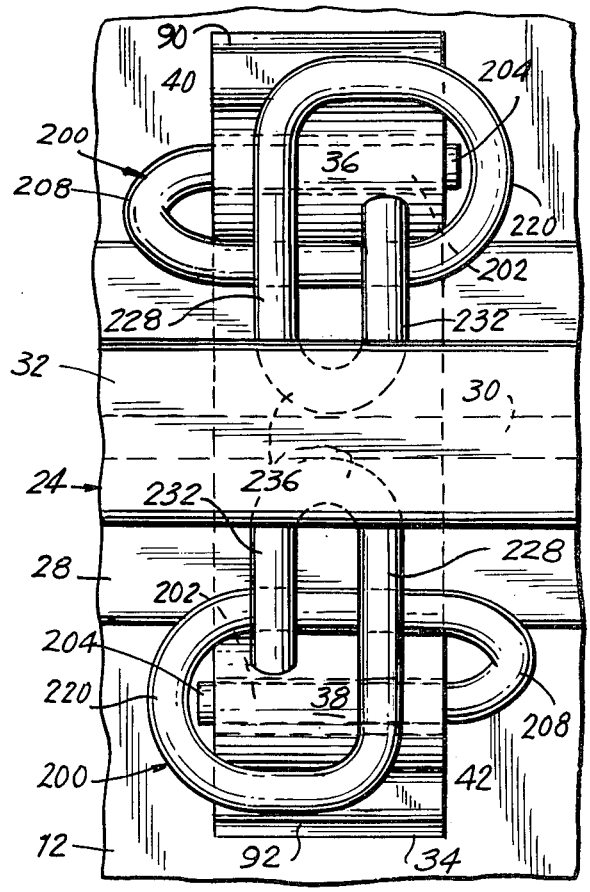
FIGS. 8, 9 and 10 are views similar to FIGS. 2, 3 and 4 showing still another embodiment of the rail fastener and brace of the present invention.
Figure 9:
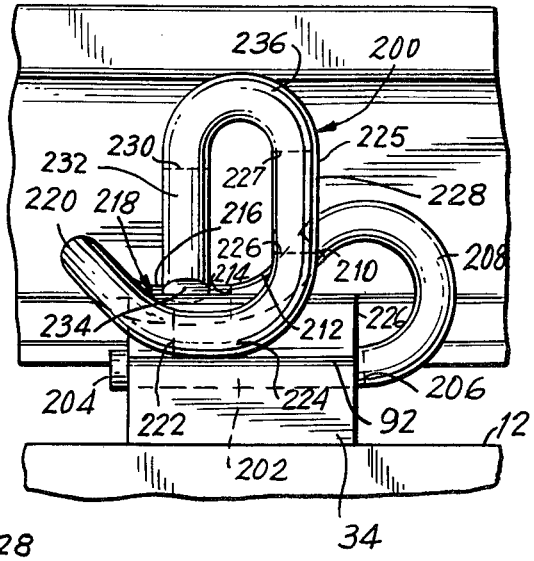
Figure 10:
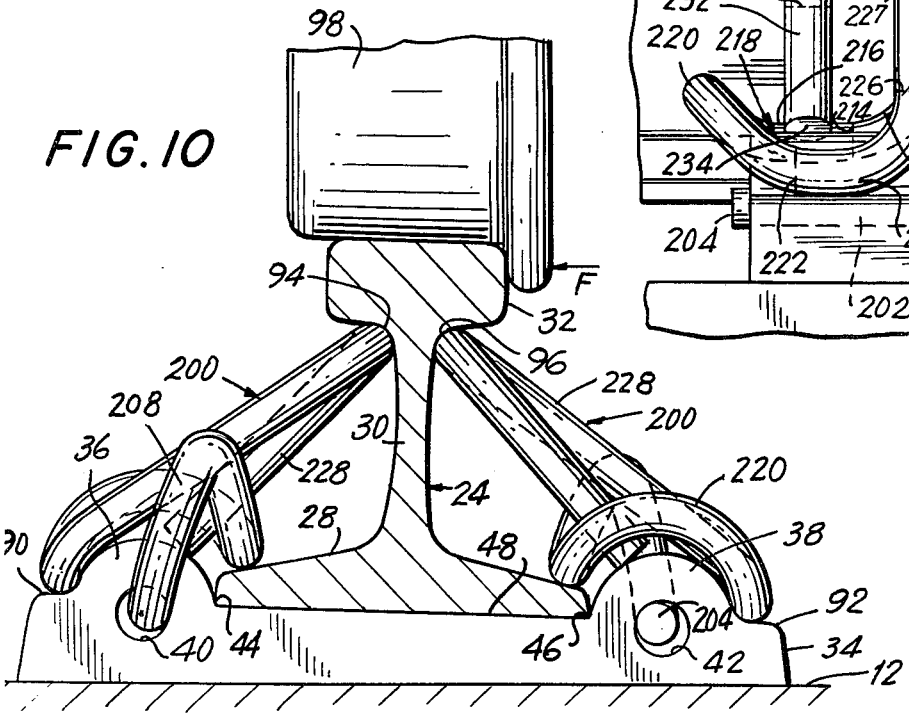

Reference is now made to FIGS. 8 through 10 for a description of yet another embodiment of the rail fastener and brace of the present invention. In the description of this embodiment like reference numerals will indicate like elements as discussed in the previous embodiments.

In this embodiment, the rail fastener and brace 200 includes a first straight leg segment 202 extending from a first end 204 to the position indicated by the dotted line 206 and continues into a reverse bend segment 208 through an approximately 270° change in orientation to the position indicated by the dotted line 210. A short gradual bend segment 212 extends from the position indicated by the dotted line 210 to the position indicated by dotted line 214 and leads into a straight leg segment 216 extending from the position indicated by dotted line 214 to the position indicated by dotted line 218. A third reverse bend segment 220, which effects a 180° change in orientation, extends from the position indicated by dotted line 218 to the position indicated by dotted line 222. A gradual bend segment 224 extends from the position indicated by dotted line 222 to the position indicated by dotted line 226. From the position indicated by dotted line 226 the fastener 200 extends in a short straight segment 225 to the position shown by dotted line 227 and then extends into a reverse bend segment 228 through an approximately 270° change in orientation to the position indicated by the dotted line 230 and terminates in a straight leg segment 232 extending from the position indicated by dotted line 230 to the end of the fastener 234. The reverse bend segment 228 includes a bend segment 236 which is the segment which is adapted to abut the shoulders 94 or 96 of the rail system.

In this embodiment the end 234 of the fastener is designed to have its end abut against the surface of the protuberances 36 or 38. By this construction where the gradual bend segment 224 rides in either shoulder 90 or 92, a further advantage is obtained in that should the reverse bend segment 228, which provides the lateral support to the rail be fractured, the integrity of that portion of the fastener which serves as the railway fastener remains intact and still functions as a fastener even though its ability to also serve as a brace is impaired. With the embodiments described in FIGS. 2 through 4 and 5 through 7, although the possibility is remote, a fracture or break in that segment of the fastener which serves as a lateral bracing means would also destroy the ability of the fastener to secure the rail to the base member 34. Hence, the alternative construction shown in FIGS. 8 through 10 may be the more preferred embodiment if an additional factor of safety is considered important in the remote possibility of a fracture to the fastener occurring.

It is thus evident that the combined rail fastener and brace of the present invention provides a unitary fastening device which serves a dual function of securing a rail to railroad ties while simultaneously providing a brace and support for the rail against lateral or horizontal forces which would tend to displace the orientation of the rail. The fastener and brace of the present invention is relatively simple to construct and install.

What is claimed is:

1. In a railway system comprising a railway rail and a fixed anchorage member supporting said rail, said rail including a flanged base segment, a vertically spaced railway wheel bearing surface and a web segment interconnecting said flanged base segment and said wheel bearing surface, a pair of raised protuberances on said anchorage member in spaced relationship with each other, at least one of said raised protuberances including a through bore having a horizontal axis, said rail being supported on said fixed anchorage member between said raised protuberances on said anchorage member, a rail fastener and brace comprising a unitary length of resilient rod material to secure said rail to said anchorage member and brace said rail against transverse forces, said rail fastener and brace being bent so as to have one segment thereof disposed within the through bore in said one protuberance on said anchorage member, a second segment in abutting relationship with the upper surface of said rail flange base segment, a third segment in bracing abutting relationship with the web segment of said rail near the juncture of said web with said wheel bearing surface and a fourth segment in abutting bearing relationship to said anchorage member to provide a torsional spring effect to secure said rail to said anchorage member while providing a brace to said rail against transverse forces.

2. The railway system as defined in claim 1 wherein said one segment of said rail fastener and brace extends within said through bore in a direction parallel to said rail.

3. In a railway system comprising a railway rail and a fixed anchorage member supporting said rail, said rail including a flanged base segment, a vertically spaced railway wheel bearing surface and a web segment interconnecting said flanged base segment and said wheel bearing surface, said rail being supported on said fixed anchorage member between raised protuberances on said anchorage member, a rail fastener and brace comprising a unitary length of resilient rod material to secure said rail to said anchorage member and brace said rail against transverse forces, said rail fastener and brace being bent so as to have one segment thereof in cooperative engagement with a said protuberance on said anchorage member, a second segment in abutting relationship with the upper surface of said rail flange base segment, a third segment in bracing abutting relationship with the web segment of said rail near the juncture of said web with said wheel bearing surface and a fourth segment in abutting bearing relationship to said anchorage member to provide a torsional spring effect to secure said rail to said anchorage members while providing a brace to said rail to said transverse forces, said protuberances on said anchorage member including a through bore therethrough, said one segment of said rail fastener and brace being disposed within said through bore, said rail fastener and brace including a first straight leg segment continuing seriatim into a first reverse bend segment, then into a second straight leg, then into a second reverse bend segment providing approximately a 180° change in orientation, then into a third straight leg segment, then into a third reverse bend segment, then into a fourth straight leg segment oriented substantially parallel to said first straight leg segment, then into a fourth reverse bend segment providing approximately a 180° change in orientation and then terminating in a short bend segment oriented substantially parallel to said first and fourth straight leg segments.

4. The railway system as defined in claim 3 wherein said fourth straight leg segment is juxtaposed in abutting relationship on said rail flanged base to secure said rail to said anchorage member, said short bend segment is disposed in abutting relationship on the shoulder formed by said protuberance and the upper surface of said anchorage member and said second reverse bend segment is disposed in abutting relationship against the shoulder formed by said rail web segment and said rail wheel bearing surface to provide a brace for said rail against forces transverse to said rail.

5. The railway system as defined in claim 4 wherein said second and third straight leg segments are not coplanar to provide a greater resistance to transverse and bending moment forces imparted to said rail.

6. The railway system as defined in claim 3 wherein said first straight leg segment is the said one segment disposed in said through bore.

7. In a railway system comprising a railway rail and a fixed anchorage member supporting said rail, said rail including a flanged base segment, a vertically spaced railway wheel bearing surface and a web segment interconnecting said flanged base segment and said wheel bearing surface, said rail being supported on said fixed anchorage member between raised protuberances on said anchorage member, a rail fastener and brace comprising a unitary length of resilient rod material to secure said rail to said anchorage member and brace said rail against transverse forces, said rail fastener and brace being bent so as to have one segment thereof in cooperative engagement with a said protuberance on said anchorage member, a second segment in abutting relationship with the upper surface of said rail flange base segment, a third segment in bracing abutting relationship with the web segment of said rail near the juncture of said web with said wheel bearing surface and a fourth segment in abutting bearing relationship to said anchorage member to provide a torsional spring effect to secure said rail to said anchorage member while providing a brace to said rail against transverse forces, said protuberances on said anchorage member including a through bore therethrough, said one segment of said rail fastener and brace being disposed within said through bore, said rail fastener and brace including a first leg segment continuing seriatim into a first reverse bend segment providing approximately a 270° change in orientation, then into a slight reverse bend segment, then into a second straight leg segment, then into a second reverse bend segment providing approximately a 270° change in orientation, then into a gradual bend segment and then terminating in a third straight leg segment oriented substantially parallel to said first and second straight leg segments.

8. The railway system as defined in claim 7 wherein said second straight leg segment is juxtaposed in abutting relationship on said rail flanged base to secure said rail to said anchorage member, said third straight leg segment is disposed in abutting relationship on the shoulder formed by said protuberance and the upper surface of said anchorage member and said second reverse bend segment effecting approximately a 270° change in orientation is disposed in abutting relationship against the shoulder formed by said rail web segment and rail wheel bearing surface to provide a brace for said rail against forces transverse to said rail.

9. The railway system as defined in claim 8 wherein the segments of said rail fastener and brace immediately adjacent that portion of said second reverse bend segment providing approximately a 270° change in orientation are not coplanar to provide a greater resistance to transverse and bending movment forces imparted to said rail.

10. The railway system as defined in claim 7 wherein said first straight leg segment is the said one segment disposed in said through bore.

11. In a railway system comprising a railway rail and a fixed anchorage member supporting said rail, said rail including a flanged base segment, a vertically spaced railway wheel bearing surface and a web segment interconnecting said flanged base segment and said wheel bearing surface, said rail being supported on said fixed anchorage member between raised protuberances on said anchorage member, a rail fastener and brace comprising a unitary length of resilient rod material to secure said rail to said anchorage member and brace said rail against transverse forces, said rail fastener and brace being bent so as to have one segment thereof in cooperative engagement with a said protuberance on said anchorage member, a second segment in abutting relationship with the upper surface of said rail flange base segment, a third segment in bracing abutting relationship with the web segment of said rail near the juncture of said web with said wheel bearing surface and a fourth segment in abutting bearing relationship to said anchorage member to provide a torsional spring effect to secure said rail to said anchorage member while providing a brace to said rail against transverse forces, said protuberances on said anchorage member including a through bore therethrough, said one segment of said rail fastener and brace being disposed within said through bore, said rail fastener and brace including a first straight leg segment continuing seriatim into a reverse bend segment providing approximately a 270° change in orientation, then into a gradual bend segment, then into a second straight leg segment, then into a second reverse bend segment providing approximately a 180° change in orientation, then into a gradual bend segment, then into a third straight led segment, then into a third reverse bend segment providing approximately a 180° change in orientation and then terminating in a fourth straight leg segment with said first and second and said third and fourth straight leg segments, respectively, being oriented substantially parallel to each other.

12. The railway system as defined in claim 11 wherein said second straight leg segment is juxtaposed in abutting relationship on said rail flanged base to secure said rail to said anchorage member, said third straight leg segment is disposed in abutting relationship on the shoulder formed by said protuberance and the upper surface of said anchorage member, said second reverse bend segment providing approximately a 180° change in orientation being disposed in abutting relationship against the shoulder formed by said rail web segment and said rail wheel bearing surface to provide a brace for said rail against forces transverse to said rail and the end of said fourth straight leg segment being oriented in abutting relationship against the upper surface of said protuberance.

13. The railway system as defined in claim 11 wherein said fourth straight leg segment and the portion of said second reverse bend segment providing approximately a 270° change in orientation immediately adjacent that portion in abutting relationship to said rail are not coplanar to provide a greater resistance to transverse and bending moment forces imparted to said rail.

14. The railway system as defined in claim 11 wherein said first straight leg segment is the said one segment disposed in said through bore.

* * * * *